United States Patent [19]

Müller et al.

[11] Patent Number: 4,566,682

[45] Date of Patent: Jan. 28, 1986

[54] ARRANGEMENT FOR REMOVING PHOTOSENSITIVE SHEETS FROM A CONTAINER

[75] Inventors: Jürgen Müller, Munich; Werner Ihm, Schwaben, both of Fed. Rep. of Germany

[73] Assignee: Agfa-Gevaert AG, Leverkusen, Fed. Rep. of Germany

[21] Appl. No.: 657,395

[22] Filed: Oct. 3, 1984

Related U.S. Application Data

[62] Division of Ser. No. 384,160, Jun. 1, 1982, abandoned.

[30] Foreign Application Priority Data

Jun. 6, 1981 [DE] Fed. Rep. of Germany ..... 3122585

[51] Int. Cl.[4] ..... B65H 3/08; B65H 1/02

[52] U.S. Cl. ..... 271/90; 271/30.1; 271/145; 271/250

[58] Field of Search ..... 271/18, 90, 107, 30 A, 271/145, 146, 210, 236, 250, 252, 30.1

[56] References Cited

U.S. PATENT DOCUMENTS 4,221,376 9/1980 Handen ..... 271/149
4,236,710 12/1980 Nakamura ..... 271/107
4,248,413 2/1981 Fox ..... 271/236

*Primary Examiner*—Bruce H. Stoner, Jr.

*Assistant Examiner*—John A. Carroll

*Attorney, Agent, or Firm*—Michael J. Striker

[57] ABSTRACT

An arrangement for removing sheets, especially X-ray film sheets, from a container in the interior of which such sheets are arranged next to one another in a stack, wherein at least some of the sheets are so dimensioned as to be movable toward and away from an abutment surface, includes at least one roller which engages at least the next sheet to be removed during a moving operation and moves the next sheet into abutment with the abutment surface. A plurality of such rollers may be arranged at the bottom region of the container such that their axes of rotation extend normal to the edges of the sheets which rest on the rollers in an upright position of the container in which the removal operation is performed. However, only one such roller may be provided, this roller being mounted on a carrier member pivotable supported on the engaging and withdrawing device, for rotation about an axis extending parallel to the major surface of the next sheet, this roller reaching through an access opening to engage the next sheet at its major surface and to propel the same toward the abutment surface. A spring extends between the carrier member and the engaging and withdrawing device, urging the carrier member, after passing through a dead-center position, into one or the other of two end positions in which the roller is respectively ahead or behind the engaging elements of the device.

10 Claims, 6 Drawing Figures

ARRANGEMENT FOR REMOVING PHOTOSENSITIVE SHEETS FROM A CONTAINER

This is a division, of application Ser. No. 384,160, filed June 1, 1982 and now abandoned.

BACKGROUND OF THE INVENTION

The present invention relates to arrangements for removing sheets from containers for such sheets in general, and more particularly to arrangements for removing X-ray photosensitive sheets through light-tightly closable openings from containers or cassettes containing such sheets.

There are already known arrangements for removing X-ray sheets from light-tightly closable containers provided with respective access openings through which such photosensitive X-ray sheets can be withdrawn through the interior of the respective container in a specially constructed apparatus which prevents light from reaching and spoiling the photosensitive sheets during the withdrawal operation. The sheets are arranged in the interior of the container next to one another and the withdrawing apparatus so supports the container during the witdrawal operation that the sheets extend substantially parallel to a vertical plane. Then, it is also known to provide the container with at least one abutment surface for the sheets, which extends substantially vertically when the container is supported on the withdrawing apparatus in the above-discussed manner.

An apparatus of this type is disclosed, for instance, in the German Pat. No. 25 37 796, in which the photosensitive sheets are moved toward the abutment provided in the interior of the container by means of a conveyor belt. However, experience with this construction has shown that the sharp edges of the photosensitive sheets easily damage the conveyor belt, and this damage may then lead to disruptions in operation.

SUMMARY OF THE INVENTION

Accordingly, it is a general object of the present invention to avoid the disadvantages of the prior art.

More particularly, it is an object of the present invention to provide an arrangement for removing sheets from a container, which does not possess the drawbacks of the conventional arrangements of this type.

Still another object of the present invention is to so construct the arrangement of the type here under consideration as to assure withdrawal of the sheets from the container under all conditions.

It is yet another object of the present invention to so design the arrangement of the above type as to be capable of giving the sheets a predetermined position in the container prior to their withdrawal.

A concomitant object of the present invention is to devise an arrangement for removing sheets from containers which is simple in construction, inexpensive to manufacture, easy to use, and reliable in operation nevertheless.

In pursuance of these objects and others which will become apparent hereafter, one feature of the present invention resides in an arrangement for removing sheets through an opening of a container, especially X-ray film sheets from a light-tightly closable container, which receives the sheets next to one another substantially parallel to a common plane, at least some of the sheets being so dimensioned as to be movable in the container along the common plane toward and away from an abutment surface, this arrangement comprising means for supporting the container in a predetermined position in which the opening is accessible; means for moving at least the next sheet to be removed along the common plane into abutment with the abutment surface, including at least one roller mounted for rotation about an axis and engaging at least the next sheet during the operation of the moving means, and means for rotating the roller about its axis in such a sense as to urge the sheet engaged thereby toward the abutment surface; and means for engaging the next sheet and withdrawing the same through the opening.

In an advantageous construction of the arrangement of the present invention, the supporting means supports the container in an upright position in which the sheets extend substantially vertically. In this context, it is very advantageous when the moving means includes at least one further roller, but preferably a plurality of such further rollers, in addition to the initially mentioned roller, all of these rollers being mounted at the bottom portion of the container as considered in the upright position of the container, for rotation about their respective axes which extend substantially normal to the common plane, these rollers then supporting the sheets from below. Advantageously, these rollers are of hardened steel.

It is further advantageous when the rotating means for the plurality of rollers includes a common drive for at least some of these rollers. Then, it is especially advantageous when this common drive includes a transmission mounted on the container and having an input member, and driving means mounted on the supporting means and having an output member engageable with the input member of the transmission in the upright position of the container on the supporting means. It is especially advantageous when the rollers of the plurality of rollers have a common tangent at the side thereof which faces the sheets.

A particular advantage obtained when the arrangement of the present invention is constructed in the above-discussed manner is that the sheets are brought into or maintained in contact with the abutment surface, as the case may be, without encountering any problems. Moreover, the rollers, especially when made of hardened steel, have, because of their increased strength and wear resistance as compared to the conventional moving elements for the sheets, an extended lifetime. This is true despite the fact that the circumferential surfaces of the rollers are in contact with sharp edges of the sheets.

In accordance with another aspect of the present invention, the moving means further includes a carrier member mounted on the engaging and withdrawing means for movement relative thereto, especially for pivoting toward and away from the next sheet, the aforementioned one roller being mounted on the carrier member for rotation about an axis which is substantially parallel to the common plane as considered in the upright position of the container on the supporting means. In this construction, the moving means further advantageously includes biasing means urging the carrier member toward a predetermined position relative to the engaging and biasing means. The engaging and biasing means advantageously includes engaging elements which define an engagement plane. Then, the biasing means includes at least one spring which urges the carrier member into a position in which the roller is closer to the sheets than the engagement plane but permits the carrier member to yield into another position in which the situation is reversed.

The arrangement of the present invention may advantageously further include means for pivoting the carrier member toward the other position thereof upon a predetermined movement of the engaging and withdrawing means toward the sheets. It is advantageous when the carrier member and the spring are so arranged relative to one another as to pass through a dead-center position during the pivoting of the carrier member between the positions thereof. Under these circumstances, there may be provided on the supporting means means for returning the carrier member from its other position through its dead-center position into its initial position upon a predetermined movement of the engaging and withdrawing means away from the sheets.

In this construction, there is obtained the advantage that the roller does not contact the sharp edge of the respective sheet; rather, it engages the major surface of the sheet. In this manner, it is avoided that the sharp edges of the sheets could influence, and especially damage, the roller.

In order to obtain a reliable operation of the arrangement of the present invention which is constructed in the manner described just above, the roller is so arranged as to extend through the opening of the container at a distance from the side of the container which is situated opposite to the abutment surface that is smaller than the corresponding dimension of the smallest-dimensioned sheet. In this manner, it is assured that the roller will engage all sheets, even the smallest-dimensioned one, and propel the same toward the abutment surface.

It is especially advantageous when the opening is provided in one of the major sides of the container, and when the engaging and withdrawing means is movable relative to the supporting means substantially transversely to the common plane as considered in the upright position of the container on the supporting means. Finally, it is also advantageous when the engaging and withdrawing means engages the next sheet at a region thereof which is within even the smallest-dimensioned sheet in abutment with the abutment means. Reliable engagement of the sheet is thus assured.

The novel features which are considered as characteristic of the invention are set forth in particular in the appended claims. The improved sheet-removing arrangement itself, however, both as to its construction and its mode of operation, together with additional features and advantages thereof, will be best understood upon perusal of the following detailed description of certain specific embodiments with reference to the accompanying drawing.

DETAILED DESCRIPTION OF THE PREFERRED EMBODIMENTS

Figure 1A:
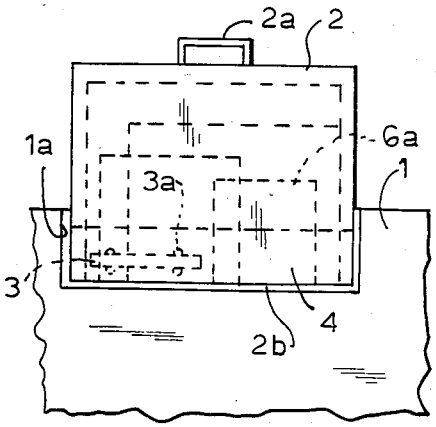
FIGS. 1*a* and 1*b* are diagrammatic side elevational views of a container, especially for X-ray film sheets, showing the orientation and distribution of sheets of different sizes in the interior of the container.
Figure 1B:
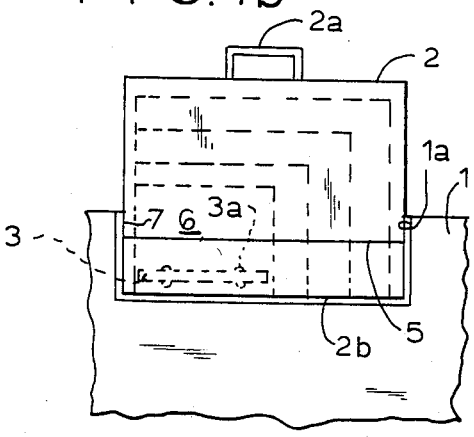

Referring now to the drawing in detail, and first to FIGS. 1*a* and 1*b* thereof, it may be seen that the reference numeral 1 has been used therein to identify an arrangement for removing sheets in accordance with the present invention. The removing arrangement 1 has an input recess 1*a*, into which a container 2 for the sheets is inserted in an upright position. An engaging and withdrawing device 3 is accommodated in the interior of the removing arrangement 1. The engaging and withdrawing device 3 can be moved, by means which has been omitted from the drawing since it is of a conventional construction and thus its illustration would only unduly clutter the drawing, toward and away from the container 2. The device 3 includes suction cups or engaging elements 3*a*, by means of which a sheet can be engaged and moved out of the container 2.

The container 2 is provided with a handgrip 2*a* and with a closure 4 which may be constructed as a hinged door, a flap, or as a sliding closure element. As shown particularly in FIG. 1*a*, the closure 4 can be moved into its open position in which it uncovers a strip-shaped access or withdrawal opening 5 that is arranged at the bottom portion of the container 2. The engaging and withdrawing means is capable of passing through this access opening 5 in its open position, so as to draw that sheet 6 which is then closest to the access opening by suction to the suction elements 3*a*. The container 2 can be an intermediate storage container or mixed-sheet receptacle or cassette, that is, a container into which sheets of various sizes are introduced in various orientations to form a stack of such sheets in the container 2. After the sheets have been introduced into the interior of the container 2 by an appropriate transport arrangement through the access opening 5, they generally assume relative positions similar to those illustrated in FIG. 1*a*. If the sheets did not have such relative positions to begin with, that is, as a result of their introduction into the interior of the container 2, such relative positions would be assumed by the sheets as a result of and during the transportation of the container 2, but at the very latest during the mounting of the container 2 on the removing arrangement or support 1 in the upright position. However, this distribution of the sheets, such as photosensitive X-ray film sheets, is not suited for the removal of the sheets from the interior of the container 2. This is so because the engaging and withdrawing device 3 and particularly the suction or engaging elements 3*a* thereof have only a dimension as considered in the longer direction of the opening 5 which corresponds to the corresponding dimension of the sheet of the smallest size or dimensions. The various sizes of the sheets are clearly shown in FIGS. 1*a* and 1*b*. It may be seen therein that, for instance, the small-size sheet 6*a* would not be engaged by the suction elements 3*a* of the engaging and withdrawing device 3 if it were situated as illustrated in FIG. 1*a* at the time of its turn to be removed. For this reason, it is necessary that all of the sheets contained in the container 2 be brought into abutment with the container 2 or parts thereof which constitute abutment surfaces not only at the lower narrow portion 2*b* of the container 2, but also at an abutment surface of portion 7 which extends substantially vertically in the illustrated position of the container 2.

This abutment can be constituted by another narrow wall of the container 2. The abutment situation of the sheets is illustrated in FIG. 1*b*. In order to bring the sheets from the random-distribution pattern or positions of FIG. 1*a* into the organized pattern or positions of abutment with the abutment surface 7 as shown in FIG. 1*b*, the present invention proposes to use the moving arrangement according to FIG. 2 or that according to FIGS. 3 to 5.

Figure 2:
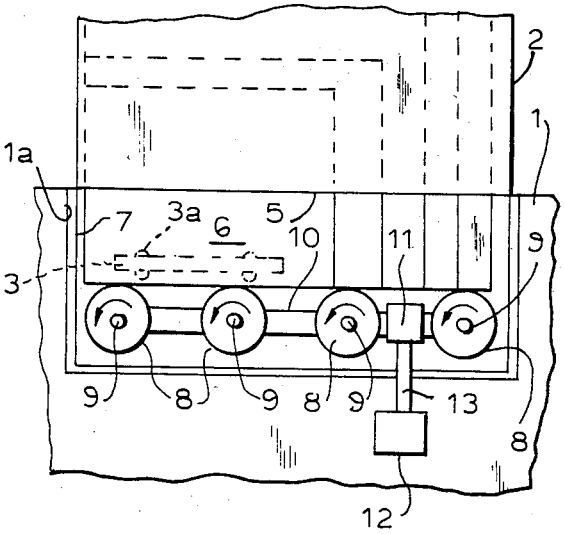
FIG. 2 is a diagrammatic fragmentary side elevational view of the container of FIG. 1 as mounted on a support, together with a first construction of the removing arrangement of the present invention.

In the construction shown in FIG. 2, the bottom of the container 2 is constituted by a plurality of rollers 8. The rollers 8 are preferably made of steel, especially hardened steel. The rollers 8 are mounted for rotation about their respective axes 9, which extend substantially transversely of or normal to the planes of the sheets. The distance of each two adjacent ones of the rollers 8 is so selected that even the smallest-dimensioned sheet rests on at least two of the rollers 8 under all operating conditions. The rollers 8 are commonly driven in rotation by an endless belt 10, which is trained around the output member of a transmission 11. The transmission is, in turn, couplable with a shaft 13 which constitutes the output member of a driving device or motor 12 that is mounted on the support or removing device 1.

In operation, the lower edges of the individual sheets 6 rest on the rollers 8, due to the gravitational forces acting on the sheets 6. Upon introduction of the container 2 into the input recess 1*a* of the removing device 1, the shaft 13 is introduced into the transmission 11 so that, after the energization of the motor 12, all of the rollers 8 are commonly driven in rotation. The rotational direction of the output shaft 13 of the motor 12 and the configuration of the transmission 11 are so selected that the rollers 8 rotate in the counterclockwise direction as considered in the drawing, as indicated by the arrows. In this manner, all of the sheets 6 are simultaneously moved toward the abutment surface 7 due to the entrainment thereof by the outer peripheries of the respective rollers 8. This movement is continued until all of the sheets 6 have come into abutment with the abutment surface 7. When this happens, all of the sheets 6, including the smallest sheet 6*a*, are in proper positions for withdrawal from the interior of the container 2 through the opening 5, so that the engaging and withdrawing means 3 can now reach through the opening 5 and engage that one of the aligned sheets 6 which is then in front as viewed through the opening 5, and withdraw such a foremost sheet 6 through the opening 5. Then, the engaging and withdrawing operation can be repeated as many times as there are sheets in the container 2, without having to keep the motor 12 energized or to re-energize it between the withdrawing operations.

Figure 4:
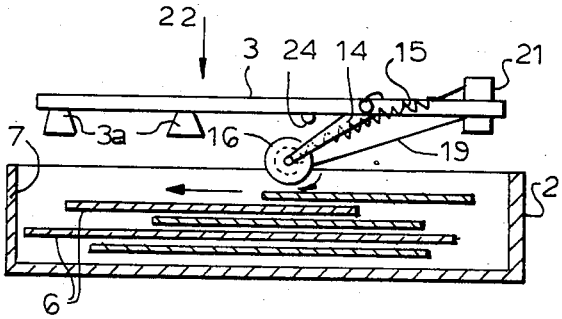
FIG. 4 is a sectional view taken on line IV—IV of FIG. 3.
Figure 3:
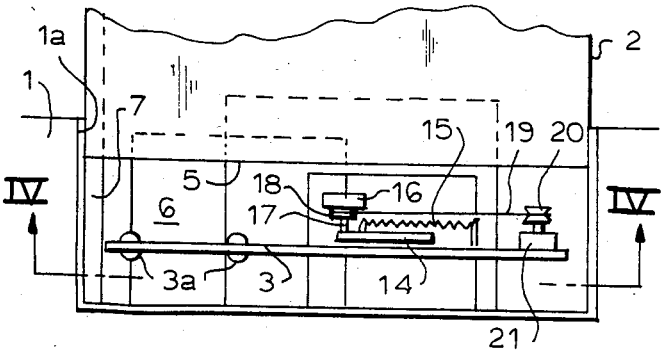
FIG. 3 is a view similar to FIG. 2 but showing a modified construction of the removing arrangement.
Figure 5:
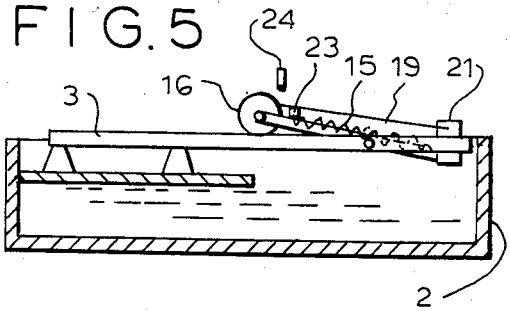
FIG. 5 is a view similar to FIG. 4 but showing the removing arrangement in a different position.

A modified construction of the moving arrangement of the present invention and the associated engaging and withdrawing device is illustrated in FIGS. 3 to 5. The engaging and withdrawing device, which is again identified by the reference numeral 3, is shown in the drawings as being located in the vicinity of the access opening 5 of the container 2 in its turned position in which it is close to but out of engagement with the next sheet 6 to be withdrawn. Generally, the engaging and withdrawing device 3 is substantially constituted by a profiled rod which carries the suction elements 3*a* at one of its ends and which can be moved by means of non-illustrated conventionally constructed means through a withdrawing range situated in front of the container 2 that is supported in the upright position on the support or removing arrangement 1. A lever or a similar carrier member 14 is pivotally mounted on the profiled rod of the engaging and withdrawing device 3. A tension spring 15 is secured at one of its ends approximately to the central portion of the carrier member 14, while the other end of the spring 15 is attached to the profiled rod of the device 3. A friction roller 16 is mounted on the free end of the carrier member 14 for rotation about an axis 17 which extends in substantial parallelism with the common plane of the sheets 6 or with the vertical plane of the abutment surface 7. A relatively smaller pulley 18 is connected to the roller 16 for rotation therewith. An elastic belt 19 is trained about the pulley 18 and another pulley 20 which is connected to an output shaft of a drive or motor 21, to transmit motion therebetween. The motor 21 is also mounted on the profiled rod of the engaging and withdrawing device 3.

Having so described the construction of the arrangement illustrated in FIGS. 3 to 5, its operation will now be discussed.

The engaging and withdrawing device 3 is moved, as shown in FIG. 4, in the direction of an arrow 22 toward the stack of juxtaposed sheets 6 through the access opening 5 of the container 2 at the commencement of the removing operation. At this time, the spring 15 holds the carrier member or lever 14 in the position shown in FIG. 4, in which the roller 16 is located ahead of the suction elements 3*a* as considered in the direction of movement 22, so that it will contact the foremost one of the sheets 6 before the suction elements 3*a* become effective. The roller 16 is rotated at a very high angular speed in the clockwise direction so that, upon engagement with the foremost sheet 6, it propels the latter toward the abutment surface 7. The speed of movement of the sheet 6 is so high that even the smallest-dimensioned sheet 6, for which the distance between the roller 16 and the abutment surface 7 is smaller than the corresponding dimension of the sheet 6, is moved by the movement impulse imparted thereto by the roller 16 all the way into abutment with the abutment surface 7.

As the engaging and withdrawing device 3 continues to move closer to the container 2 in the direction of the arrow 22, the carrier member 14 is pivoted in the clockwise direction relative to the profiled rod of the device 3, until the carrier member 14 and the spring 15 pass through their dead-center position and the spring 15 flips the carrier member 14 into its other end position in which the roller 16 is situated behind the suction elements 3*a*, again as considered in the direction of movement indicated by the arrow 22. This other position is determined by abutment of the carrier member 14 with a stop 23 connected to the profiled rod of the device 3, as shown in FIG. 5. In the meantime, the engaging and withdrawing device 3 reaches the foremost sheet 6, its suction elements 3*a* engage this sheet 6 and attract the same to themselves, and dissociate this sheet 6 from the rest of the sheets 6, if any, in the stack contained in the interior of the container 2. This is followed by a motion of the engaging and withdrawing device in the opposite direction, that is, away from the container 2, with the foremost sheet 6 being still attracted to the suction elements 3*a* of the device 3 so that it is withdrawn from the interior of the container 2 through the access opening 5. When the withdrawal operation is completed and the engaging and withdrawing device 3 continues its movement away from the container 2, it eventually reaches a point at which a stop 24 which is stationarily mounted on the support 1 engages the carrier member 14. During further movement of the device 3 opposite the direction of the arrow 22, the stop 24 retains the carrier member 14, so that the latter conducts a pivoting movement relative to the profiled rod of the engaging and withdrawing device 3 in the counterclockwise direction, until the carrier member 14 and the spring 15 again pass, this time in the opposite direction, through their dead-center position, so that the spring 15 flips the carrier member 14 over into its initial position which is illustrated in FIG. 4. Once this occurs, the sheet-removing arrangement is ready for repeating the above-discussed operation with the next-following sheet 6, commencing with the bringing of such sheet 6 into abutment with the abutment surface 7, if not already in existence.

Additionally, a slip coupling may be provided in the drive 21, in order to assure that, when the roller 16 engages a sheet 6, especially a large-size sheet 6, which is already in or close to abutment with the abutment surface 7, it will not rub on the surface of the sheet 6 and thus possibly damage the same. The roller 16 is arranged at such a location of the container 2 assuming its upright position on the supporting arrangement 1 that its distance from the side of the container 2 which is situated opposite to the abutment surface 7 is slightly smaller than the corresponding dimension of the smallest-dimensioned sheet 6. In this manner, it is assured that the roller 16 will engage even the smallest-dimensioned sheet 6 and propel the same toward and into abutment with the abutment surface 7.

It will be understood that each of the elements described above, or two or more together, may also find a useful application in other types of arrangements differing from the type described above.

While the invention has been illustrated and described as embodied in an arrangement for removing X-ray film sheets from the interior of a light-tightly closable container having an access opening at one of its major sides, it is not intended to be limited to the details shown since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims:

1. An arrangement for removing sheets through an opening of a container, especially X-ray film sheets from a light-tightly closable container, which receives the sheets next to one another substantially parallel to a common plane, at least some of the sheets being so dimensioned as to be movable in the container along the common plane toward and away from an abutment surface, comprising means for supporting the container in a predetermined position in which the opening is accessible; means for moving at least the next sheet to be removed along the common plane into abutment with the abutment surface, including at least one roller mounted for rotation about an axis and engaging at least the next sheet during the operation of the moving means, and means for rotating said roller about said axis so as to maintain said roller in contact with said next sheet and to urge the sheet engaged by said roller to move toward the abutment surface; and means for engaging the next sheet and withdrawing the same through the opening, said moving means further includes a carrier member mounted on said engaging and withdrawing means for movement relative thereto, said roller being mounted on said carrier member for rotation about an axis which is substantially parallel to the common plane.

2. The arrangement as defined in claim 1, wherein said carrier member is mounted on said engaging and withdrawing means for pivoting relative thereto and away from the next sheet.

3. The arrangement as defined in claim 2, wherein said moving means further includes biasing means urging said carrier member toward a predetermined position relative to said engaging and withdrawing means.

4. The arrangement as defined in claim 3, wherein said engaging and withdrawing means includes engaging elements defining an engagement plane; and wherein said biasing means includes at least one spring which urges said carrier member into a position in which said roller is closer to the sheets than the engagement plane but permits the carrier member to yield into another position in which the engagement plane is closer to the sheets than said roller.

5. The arrangement as defined in claim 4, and further comprising means for pivoting the carrier member toward said other position thereof upon a predetermined movement of said engaging and withdrawing means toward the sheets.

6. The arrangement as defined in claim 5, wherein said carrier member and said spring are so arranged relative to one another as to pass through a dead-center position during the pivoting of said carrier member between said positions thereof.

7. The arrangement as defined in claim 6, and further comprising means on said supporting means for returning said carrier member from said other position through the dead-center position into its initial position upon a predetermined movement of said engaging and withdrawing means away from the sheets.

8. The arrangement as defined in claim 1, wherein said roller passes through the access opening at a distance from the side of the container which is situated opposite to the abutment surface which is smaller than the corresponding dimension of the smallest-dimensioned sheet.

9. The arrangement as defined in claim 1, wherein said opening is provided in one of the major sides of the container; and wherein said engaging and withdrawing means is movable relative to said supporting means substantially transversely to the common plane as considered in said upright position of the container.

10. The arrangement as defined in claim 9, wherein said engaging and withdrawing means engages the next sheet at a region thereof which is within even the smallest-dimensioned sheet in abutment with the abutment surface.

* * * * *